US011714386B2

(12) United States Patent
Born et al.

(10) Patent No.: US 11,714,386 B2
(45) Date of Patent: Aug. 1, 2023

(54) HOROLOGICAL RESONATOR MECHANISM WITH INERTIAL MASS WITH ADJUSTMENT OF INERTIA AND/OR UNBALANCE

(71) Applicant: The Swatch Group Research and Development Ltd, Marin (CH)

(72) Inventors: Jean-Jacques Born, Morges (CH); Lionel Paratte, Marin-Epagnier (CH); Gianni Di Domenico, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 484 days.

(21) Appl. No.: 17/038,025

(22) Filed: Sep. 30, 2020

(65) Prior Publication Data

US 2021/0173350 A1 Jun. 10, 2021

(30) Foreign Application Priority Data

Dec. 9, 2019 (EP) ..... 19214354

(51) Int. Cl.
*G04B 17/06* (2006.01)
*G04D 7/08* (2006.01)
*G04B 17/28* (2006.01)

(52) U.S. Cl.
CPC ..... *G04D 7/084* (2013.01); *G04B 17/28* (2013.01); *G04B 17/063* (2013.01)

(58) Field of Classification Search
CPC ..... G04B 17/063; G04B 17/06; G04B 18/04; G04B 18/021; G04B 18/02; G04D 7/084
See application file for complete search history.

(56) References Cited

U.S. PATENT DOCUMENTS 862,465 A * 8/1907 Freund ..... G04B 18/00 368/170
3,382,667 A * 5/1968 Van Horn ..... G04B 18/006 368/171

(Continued)

FOREIGN PATENT DOCUMENTS

CH 703 462 A2 1/2012
CH 703 605 B1 2/2012

(Continued)

OTHER PUBLICATIONS

Combined Chinese Office Action and Search Report dated Dec. 16, 2021 in Patent Application No. 202011316874.X (with English language translation and English translation of Category of Cited Documents), 15 pages.

(Continued)

*Primary Examiner* — Sean Kayes
(74) *Attorney, Agent, or Firm* — Oblon, McClelland, Maier & Neustadt, L.L.P.

(57) ABSTRACT

An inertial mass with adjustment of inertia and/or unbalance for a horological resonator, including a plurality of mobiles for adjusting inertia and/or unbalance, toothed or fluted, each mounted pivotably about a mobile axis with respect to a flange that the inertial mass includes, and with a centre of mass off-centre with respect to this mobile axis, each mobile cooperating by meshing with an inertia and/or unbalance adjustment crown, toothed or fluted, under a permanent constraint exerted by an elastic return force exerted by the crown and/or the mobile.

24 Claims, 12 Drawing Sheets

(56) References Cited

U.S. PATENT DOCUMENTS

| | | | | |
|---|---|---|---|---|
| 3,455,104 | A * | 7/1969 | McCullough | G04B 18/006 368/170 |
| 8,414,184 | B2 * | 4/2013 | Mallet | G04B 18/006 368/170 |
| 9,128,465 | B2 * | 9/2015 | Kawauchiya | G04B 18/006 |
| 9,547,278 | B2 * | 1/2017 | Graf | G04B 18/006 |
| 9,989,922 | B2 * | 6/2018 | Zaugg | G04B 17/063 |
| 2012/0014229 | A1 * | 1/2012 | Mallet | G04B 18/006 368/170 |
| 2015/0185700 | A1 * | 7/2015 | Kawauchiya | G04B 17/063 368/127 |

FOREIGN PATENT DOCUMENTS

| | | | |
|---|---|---|---|
| CN | 107463083 | A | 12/2017 |
| CN | 107957671 | A | 4/2018 |
| EP | 1 705 534 | A1 | 9/2006 |
| EP | 3 252 545 | A1 | 12/2017 |
| FR | 351979 | | 7/1905 |
| FR | 675597 | | 2/1930 |
| FR | 1598034 | | 6/1970 |

OTHER PUBLICATIONS

European Search Report dated May 19, 2020 in European Application 19214354.3 filed Dec. 9, 2019 (with English Translation of Categories of Cited Documents), 8 pages.

* cited by examiner

HOROLOGICAL RESONATOR MECHANISM WITH INERTIAL MASS WITH ADJUSTMENT OF INERTIA AND/OR UNBALANCE

CROSS-REFERENCE TO RELATED APPLICATION

This application claims priority to European Patent Application No. 19214354.3 filed on Dec. 9, 2019, the entire disclosure of which is hereby incorporated herein by reference.

FIELD OF THE INVENTION

The invention relates to an inertial mass with adjustment of inertia and/or unbalance for a horological resonator.

The invention also relates to an inertia and/or unbalance adjustment assembly for a horological resonator, including at least one such inertial mass with adjustment of inertia and/or unbalance.

The invention also relates to a horological resonator including at least one such inertial mass with adjustment of inertia and/or unbalance or at least one such inertia and/or unbalance adjustment assembly.

The invention also relates to a horological movement including at least one such horological resonator.

The invention also relates to a timepiece, in particular a watch, including at least one such horological movement.

The invention also relates to a method for adjusting inertia and/or unbalance of an inertial mass for a horological resonator.

The invention relates to the field of the adjustment of the running of horological mechanisms.

BACKGROUND OF THE INVENTION

The document EP 3252545 B1 in the name of Swatch Group Research & Development Ltd describes a system for adjusting the inertia and the frequency of a balance of a mechanical horological movement without opening the watch case. This document also describes several geometries of adjustable balances.

The document FR 675597A in the name of Izurieta Chiriboga describes escapement devices and horological regulators, with various characteristics separately or in combination:

- special escapement member driven in a silent continuous rotation movement by the teeth of an escapement wheel;
- teeth of this escapement wheel with a profile conjugate with that of the escapement member;
- regulator member consisting of a disc driven in a continuous rotation movement by the escapement member either directly or indirectly; this disc is provided with a lever constrained to rotate with the disc, this lever moving in front of a graduation and carrying toothed sectors intended to act on wheels provided with inertia blocks attached to the disc and the various positions of which make it possible to vary the speed of rotation of the disc without impairing the indifferent equilibrium position of the assembly;
- these wheels provided with inertia blocks are independent of each other, suitable graduations making it possible to know the respective adjustment thereof in order to preserve the indifferent equilibrium position;

- the escapement wheel communicates a rotation movement to the escapement member, to the arbor of which the disc provided with the regulator device is directly fixed;
- the rotation movement of the escapement member is communicated to an arbor carrying the disc and its regulator by means of a toothed wheel and a pinion, the latter, having a smaller number of teeth than the wheel, communicates to the regulator assembly a reverse rotation speed greater than that of the escapement member;
- in the drive device, toothed wheel, pinion, the arbor of the pinion and of the escapement member is provided with a disc forming an additional mass.

The document CH 703462 in the name of Nivarox describes an equipped horology balance, with inertia setting for adjusting the inertia thereof and/or the balance thereof and/or the oscillation frequency thereof, including, at the periphery of the felloe thereof, at least one housing for receiving at least one insert, said insert including complementary guidance means with a profile complementary to guidance means that this housing includes. The balance and/or the insert includes elastic holding means that are arranged to allow, in a first insertion position where these elastic holding means are under constraint, the insertion of an insert in a housing, and to prevent, in a second holding position where these elastic holding means are released, the extraction of this insert out of this housing. The insert is able to move in translation and/or in rotation in its housing, in particular between discrete positions.

SUMMARY OF THE INVENTION

The present invention sets out to define a horological resonator mechanism including an inertial mass, in particular a balance with adjustable inertia, that can supplement the designs described in the documents EP 3252545 B1 and EP 3252546 B1 in the name of Swatch Group Research & Development Ltd, making it possible to increase the range of adjustment of the inertia.

The invention also sets out to enable the operator or the user carrying out an adjustment of running to refer to a table directly correlating the deviation in running with discrete positions imposed on mobiles included in the inertial mass mechanism according to the invention.

For this purpose, the invention relates to an inertial mass with adjustment of inertia and/or of unbalance for a horological resonator, according to claim 1.

The invention also relates to an inertia and/or unbalance adjustment assembly for a horological resonator, including at least one such inertial mass with adjustment of inertia and/or of unbalance.

The invention also relates to a horological resonator including at least one such inertial mass with adjustment of inertia and/or of unbalance or at least one such inertia and/or unbalance adjustment assembly.

The invention also relates to a horological movement including at least one such horological resonator.

The invention also relates to a timepiece, in particular a watch, including at least one such horological movement.

The invention also relates to a method for adjusting inertia and/or unbalance of an inertial mass for a horological resonator.

SUMMARY DESCRIPTION OF THE DRAWINGS

Other features and advantages of the invention will emerge from a reading of the following detailed description, with reference to the accompanying drawings, where:

FIG. 1 shows, schematically, and in plan view, an inertial mass according to the invention, in the form of a complete balance, resulting from assembling a lower flange, an upper flange, an elastic crown and mobiles for adjusting inertia and/or unbalance, which are here satellites with unbalance, here non-limitatively arranged two-by-two in symmetry with respect to the oscillation axis of this balance;

Figure 1:
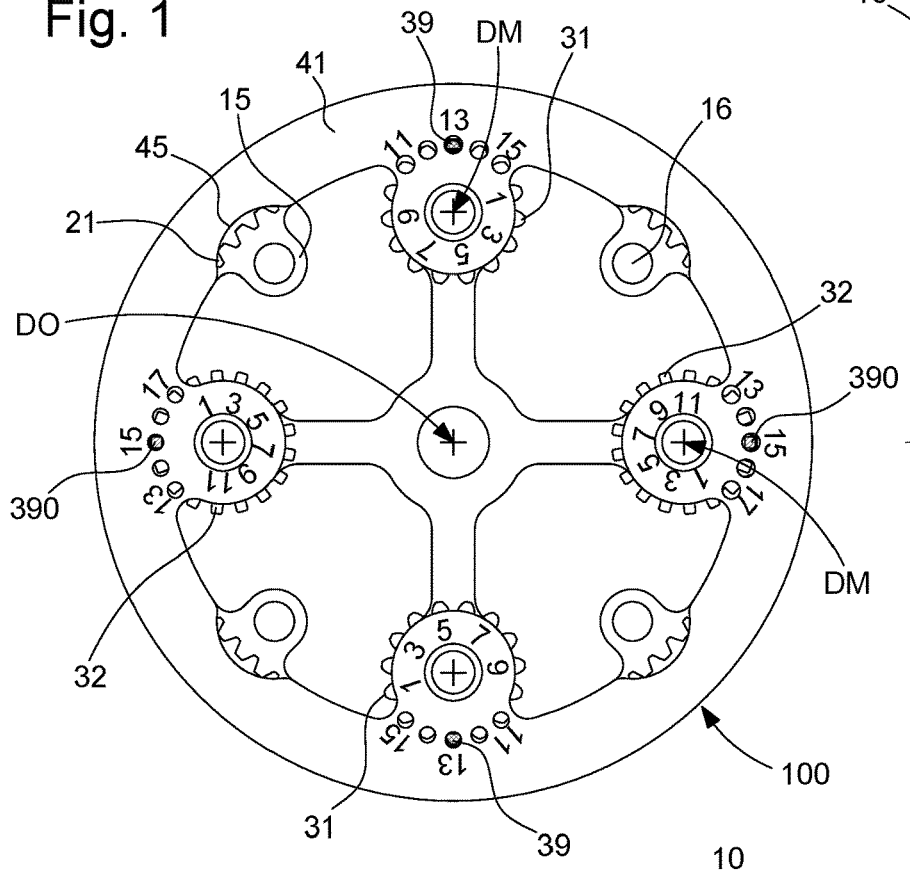
Figure 5:
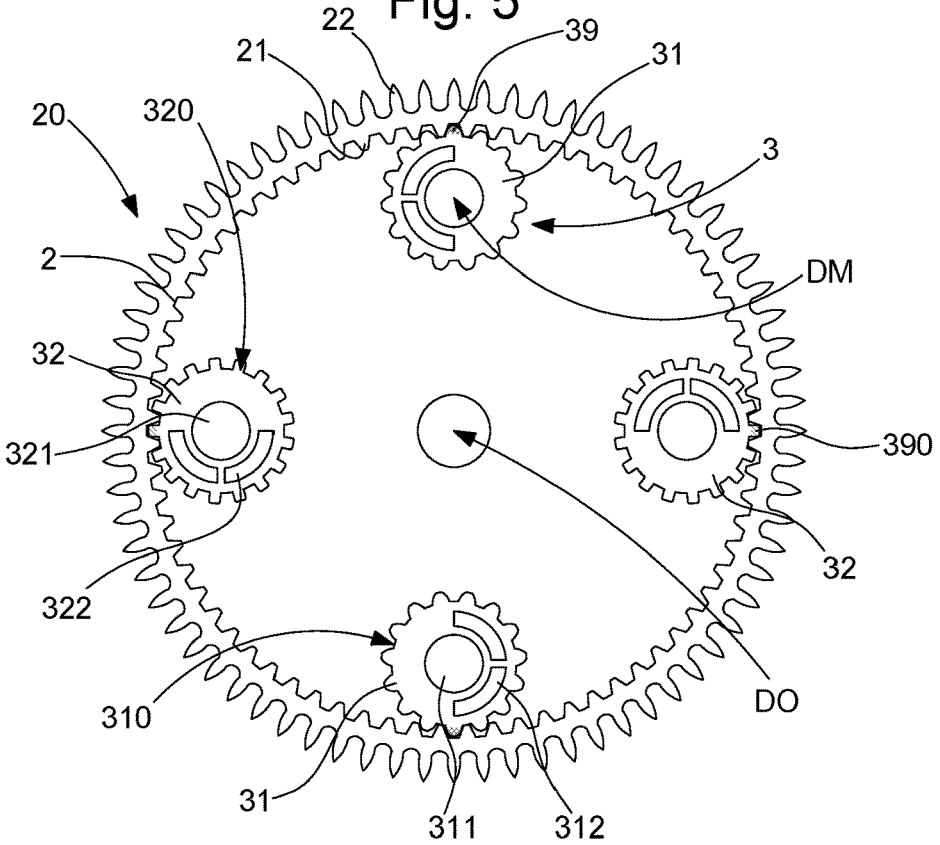
FIG. 5 shows, in a similar way to FIG. 1, the crown meshing with four satellites, two of a first type with 15 teeth arranged at noon and six o'clock, and two of a second type with 17 teeth arranged at three o'clock and nine o'clock.
Figure 6:
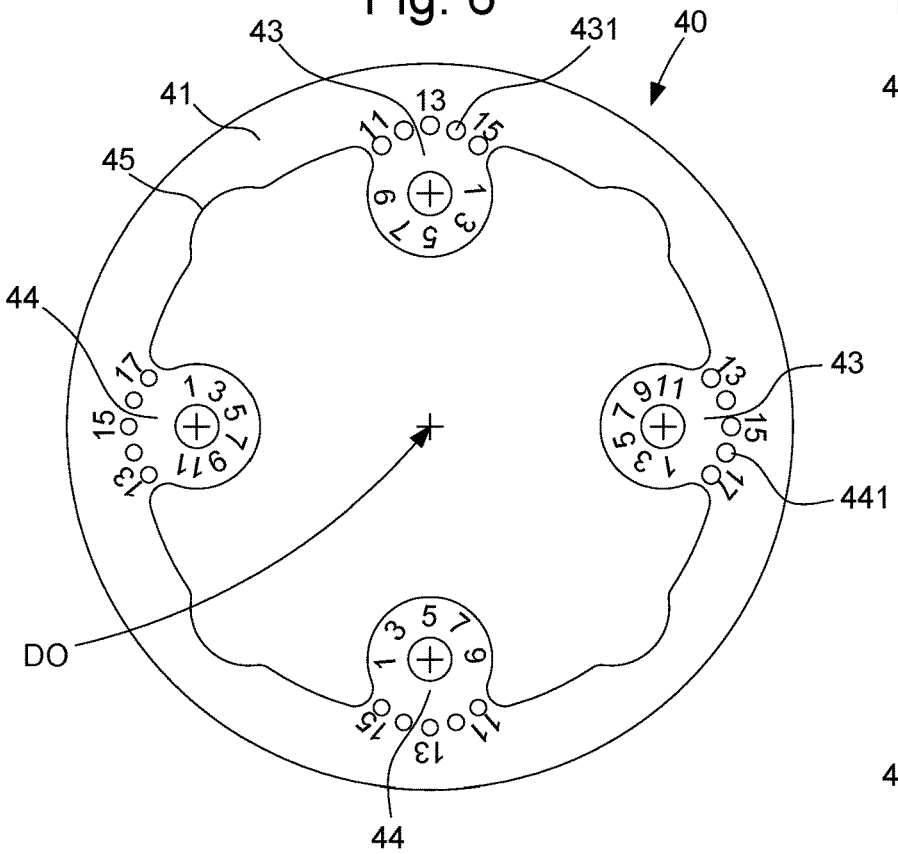
FIG. 6 shows, in a similar way to FIG. 1, the single upper flange.
Figure 7:
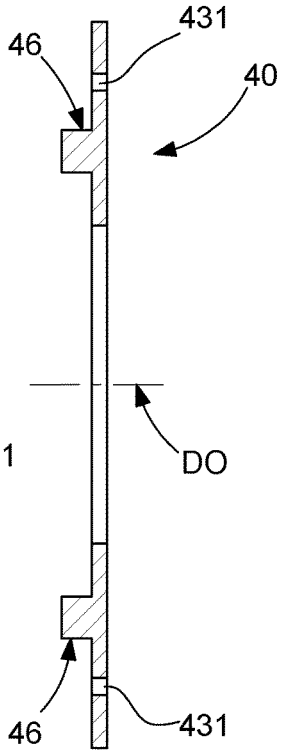
FIG. 7 shows, in a similar way to FIG. 2, the upper flange of FIG. 6.
Figure 9B:
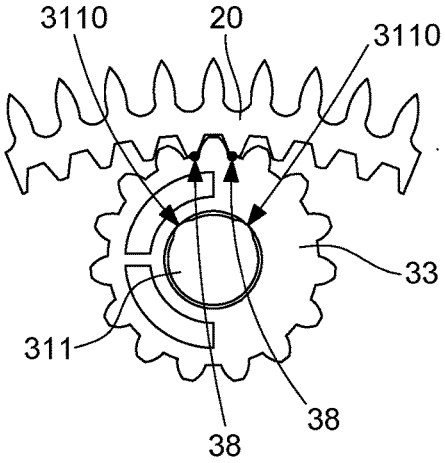
FIG. 9B illustrates another variant wherein each mobile 3 is carried by a shaft or a journal provided with two slight protuberances, and thus the point of contact form together a trapezium of forces, which confers a positioning of the satellite that is even better than with the triangle of forces formed by the points of contact in FIG. 9A.
Figure 9A:
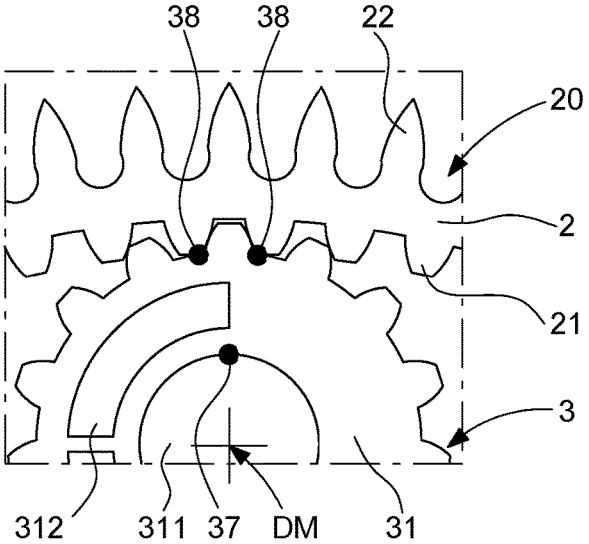
FIG. 9A is a detail of FIG. 5 showing the meshing between the crown and a satellite of the first type, which include teeth with different profiles, and the points of contact between them forming a triangle of forces, which confers stable positioning on the satellite.
Figure 10:
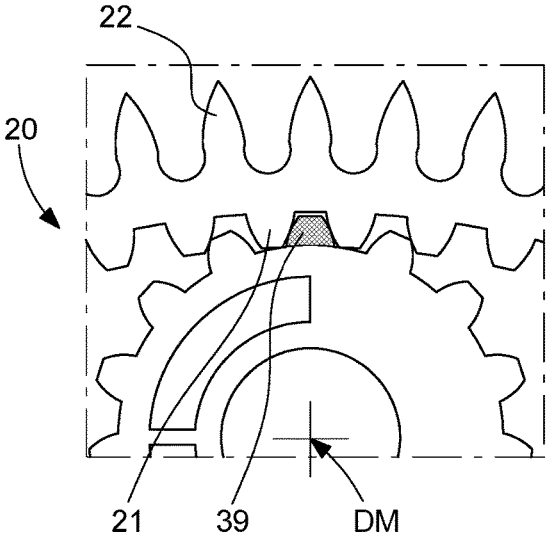
Figure 11:
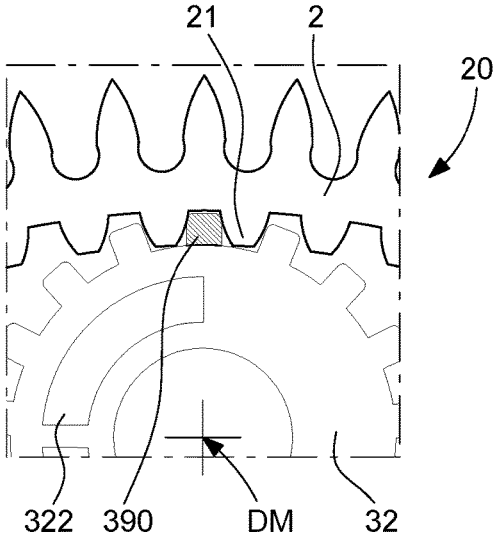
Figure 12:
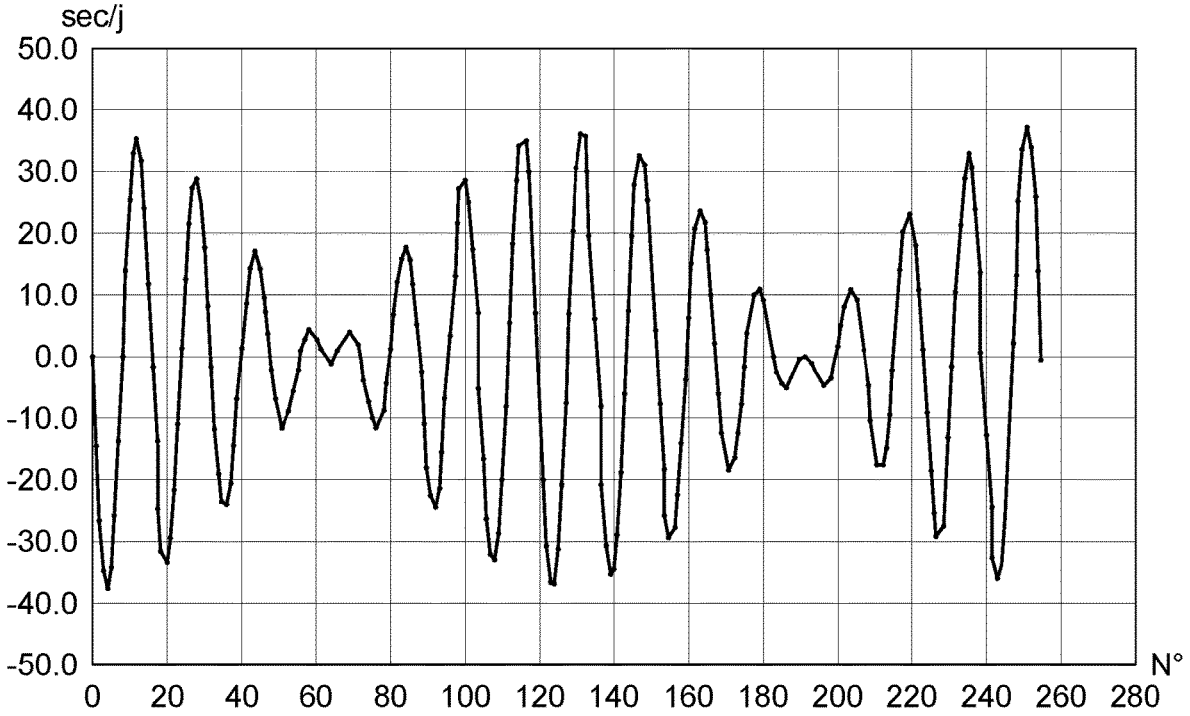
Figure 13:
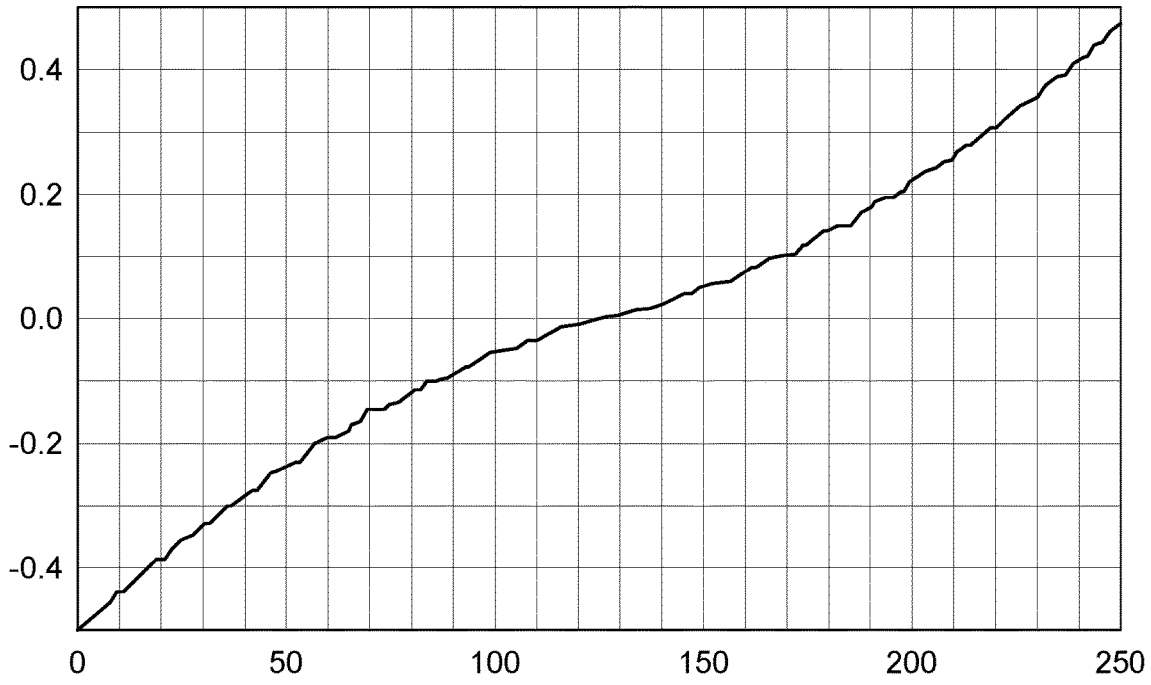
Figure 14:
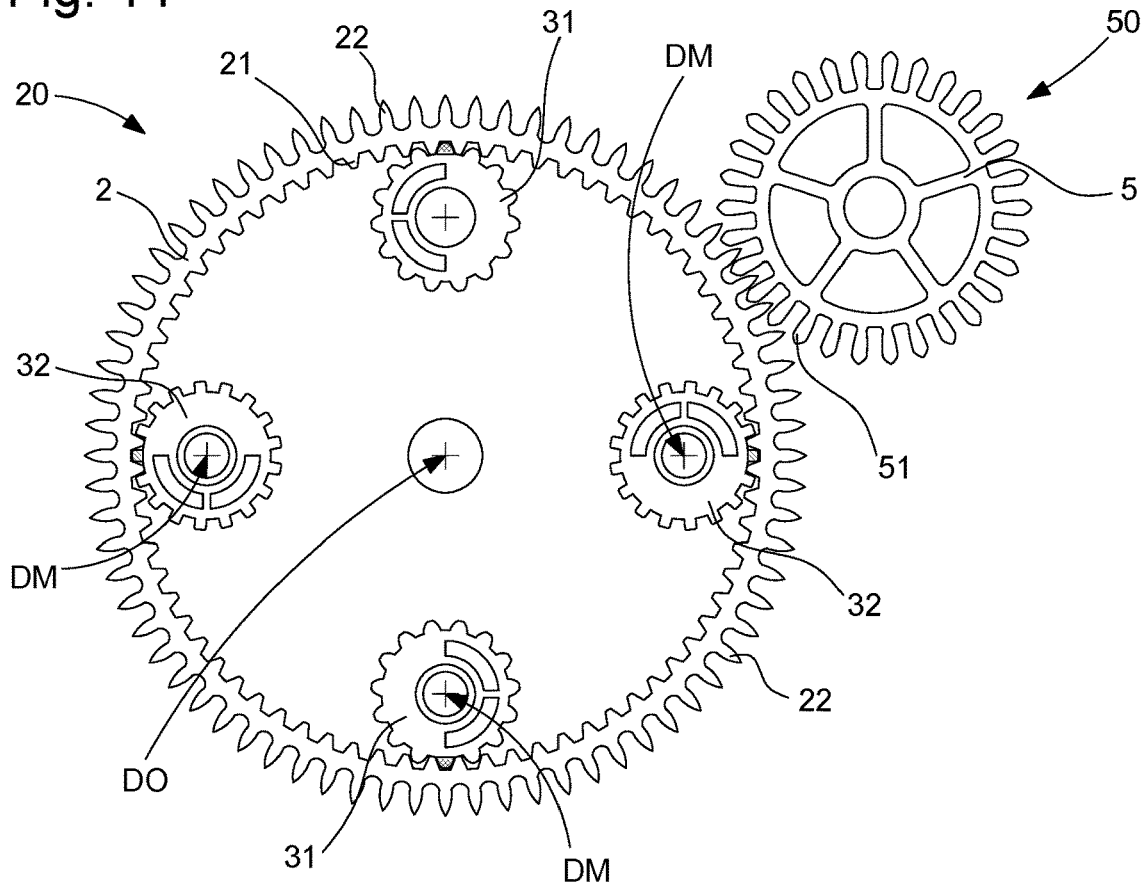
Figure 15:
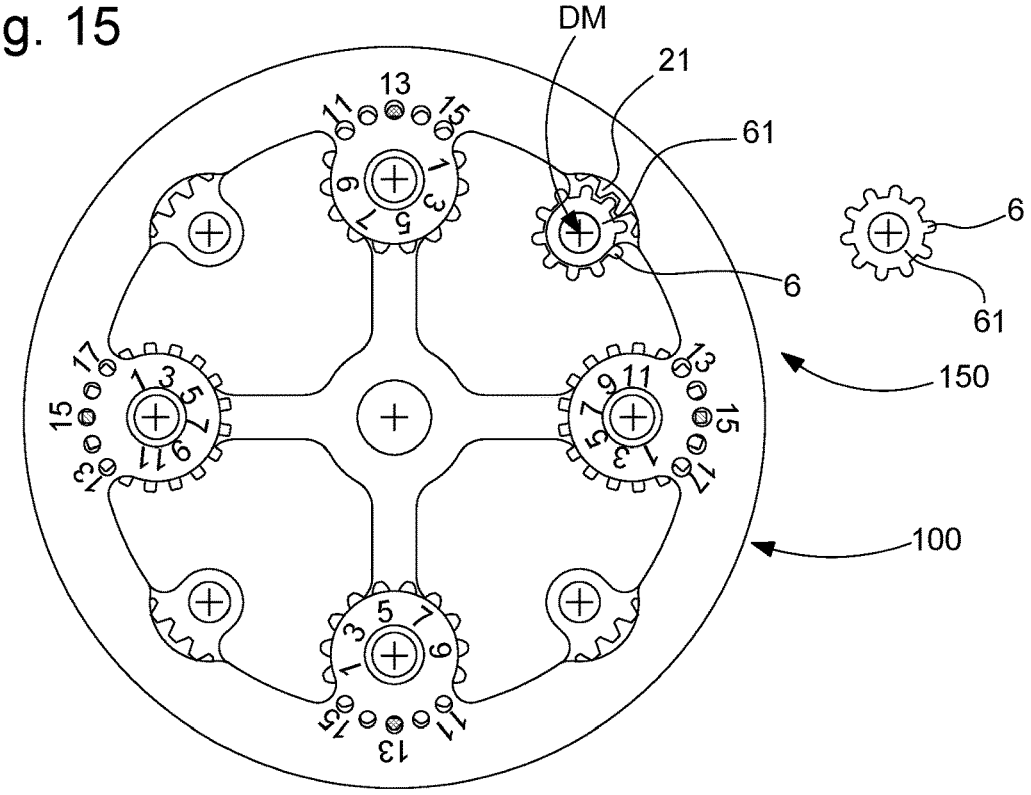
Figure 16:
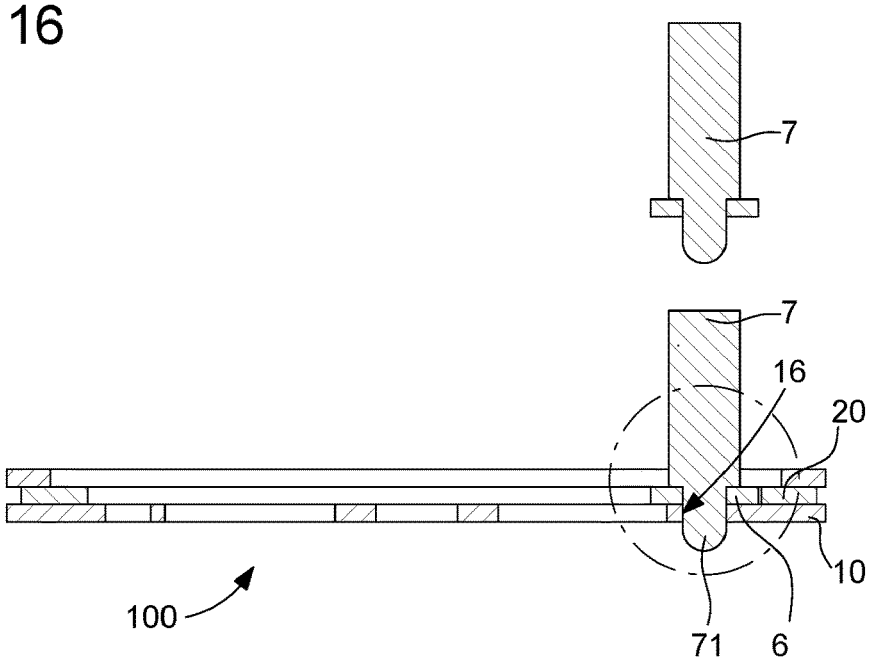
Figure 17:
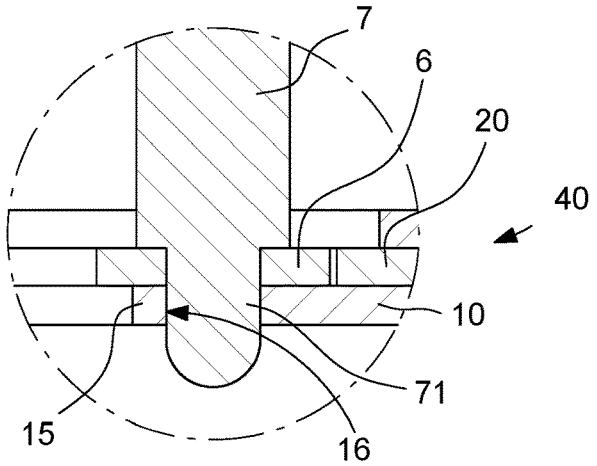
Figure 18:
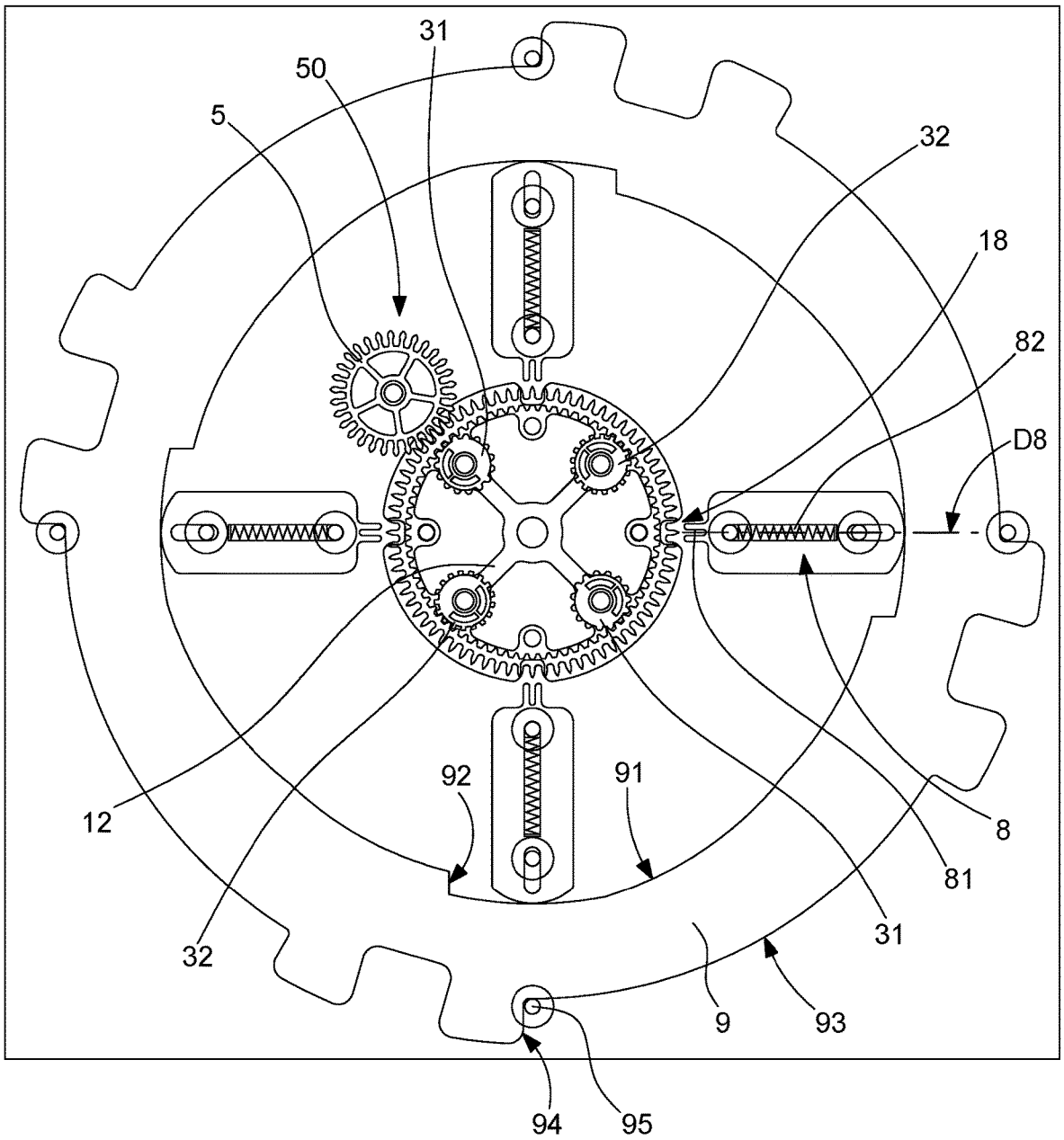
Figure 19:
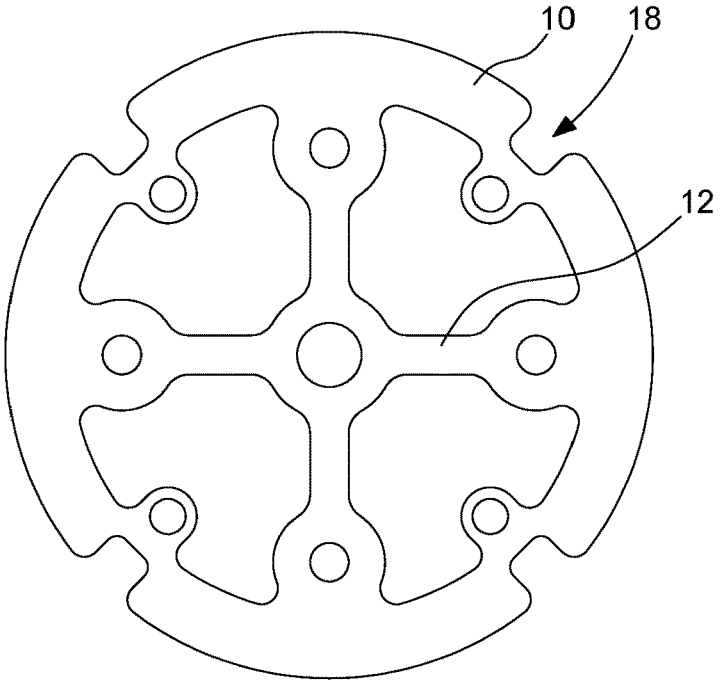
Figure 20:
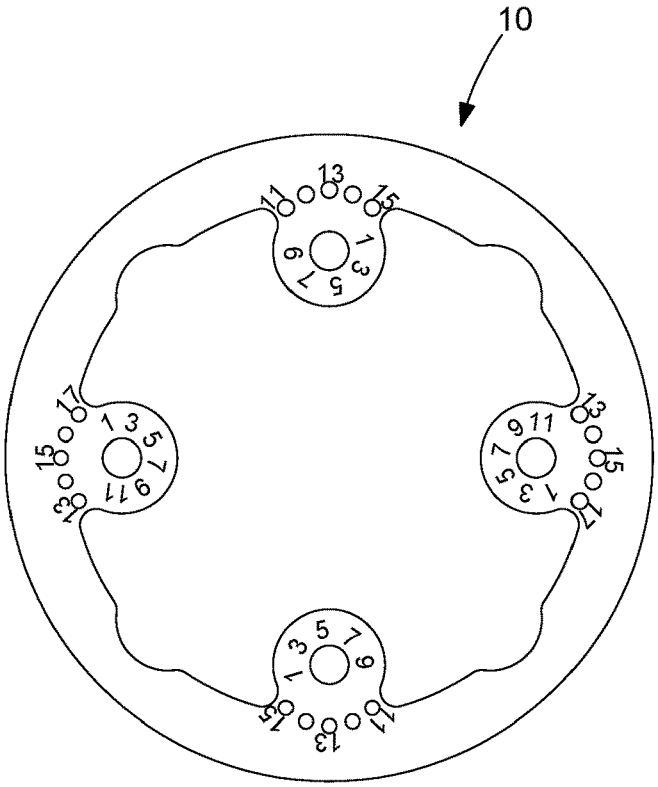
Figure 28:
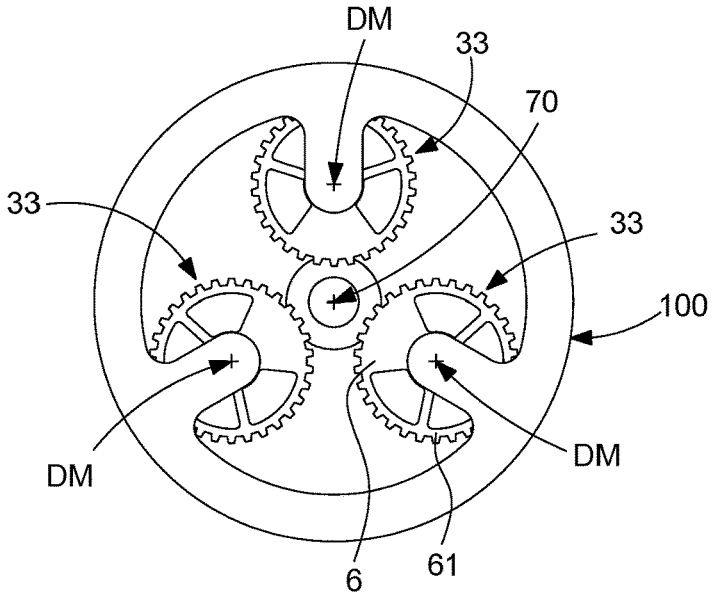
Figure 29:
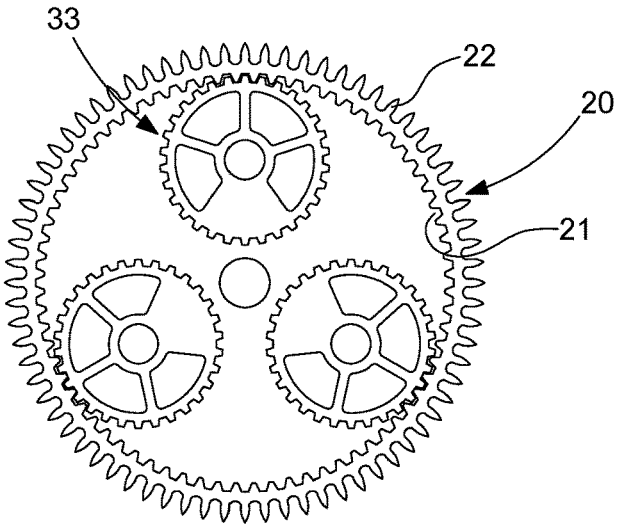
Figure 30:
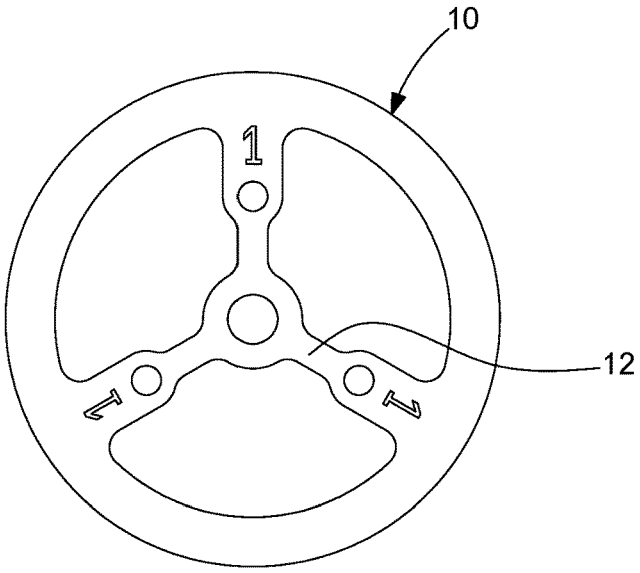

FIGS. 10 and 11 show, in a similar way to FIG. 9, the detail of the meshing of a crown with internal teeth with substantially straight flanks, with mobiles for inertia and/or unbalance adjustment that are respectively a satellite of the first type with a set of teeth with 15 teeth substantially in the form of an involute of a circle, and a satellite of the second type with a set of teeth with 17 teeth substantially with a square profile;

FIG. 12 is a distribution diagram showing on the x axis the two 255 possible positions with this particular combination of mobiles for adjusting inertia and/or unbalance, in particular first satellites with 15 teeth and second satellites with 17 teeth, and on the y axis the deviation in running, in seconds per day, which allows each of these combinations; a substantially sinusoidal distribution with a moiré effect, and the large number of combinations, allowing both high resolution and a large adjustment range; the following description gives, partially, an example of a table indicating, for each position of the satellites and of the crown, the corresponding variation in inertia, which results directly in the associated deviation in running;

FIG. 13 shows all the inertias relating to the total range of variation in inertia corresponding to the 255 positions, ordered in increasing inertia values, and illustrates the very small difference that can be controlled between two consecutive discrete inertia values;

FIG. 14 shows, in a similar way to FIG. 5, the same set of crown and satellites, where the crown includes external teeth, which cooperate directly or indirectly with a driving wheel that is not a fixed member, and which may be external to the horological movement, or which meshes with a wheel internal to the horological movement;

FIG. 15 shows, in a similar way to FIG. 5, the same crown and satellite set, where the internal teeth of the crown mesh with a small wheel, which may be internal to the horological movement, or, as shown in this figure, which is the end of a tool external to the movement, guided by a bore that the lower flange includes; the inertial mass and this external tool then constituting an inertia adjustment assembly;

FIG. 16 shows, in side view, the cooperation shown in FIG. 15, and FIG. 17 is a detail of the end of this tool;

FIG. 18 shows, in a similar way to FIG. 1, another inertial mass constructed on the same principle, shown with a tool adapted for introducing the satellites: a ring includes external eccentric means constituting cams for the radial movement of sliding carriages arranged to immobilise or release the toothed elastic crown, when this ring is rotated through 90°, the sliding carriages compress and deform the annular spring, which makes it possible to place the satellites easily without colliding with the elastic crown;

FIGS. 19 and 20 are details of flanges of certain variants;

FIGS. 21 to 26 show, in a similar way to FIGS. 1 to 7, a balance allowing adjustment of the inertia and of the unbalance, and including satellites cooperating with elastic blades: the satellites pivoting on journals (or shafts) formed on the flanges, the elastic blades allowing a small radial movement of the satellites, and indexing the angular movement of the satellites in discrete positions;

FIGS. 28 to 30 show, in plan view, another inertial mass constructed on the same principle, the unbalances of the satellites of which are synchronised, and are not diametrically opposed, and details of the construction thereof.

Figure 33:
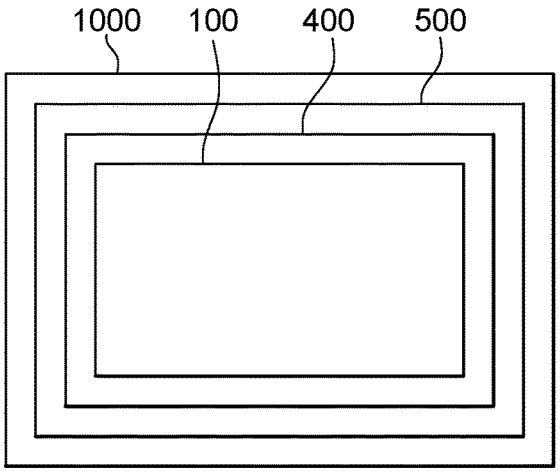
Figure 21:
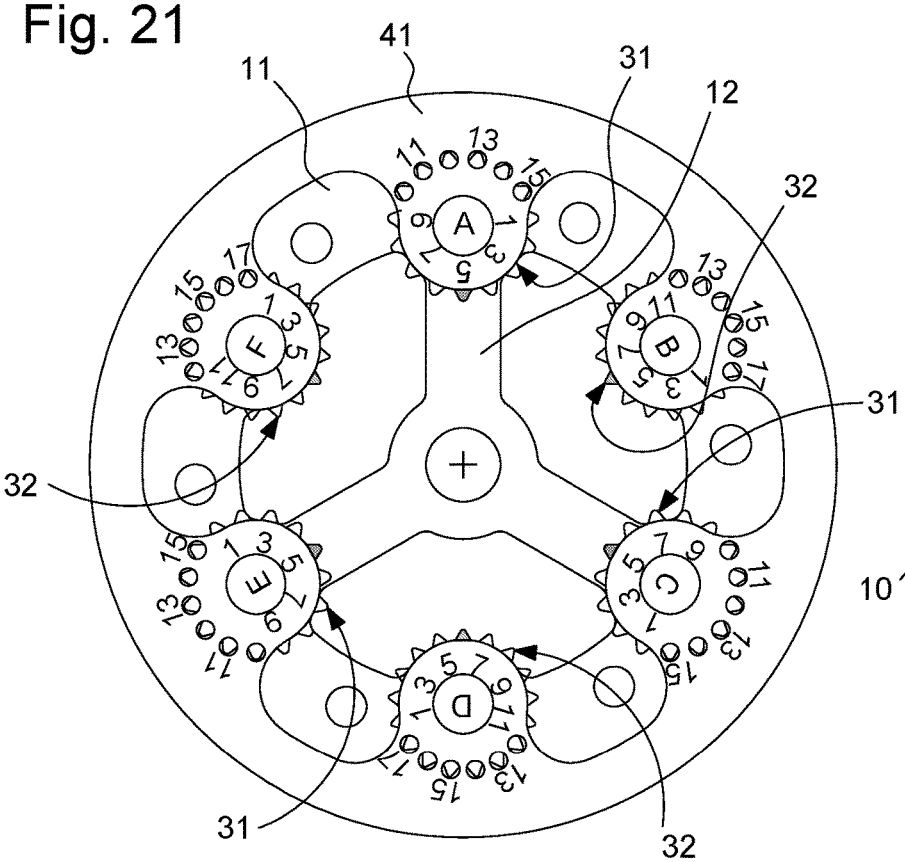
Figure 22:
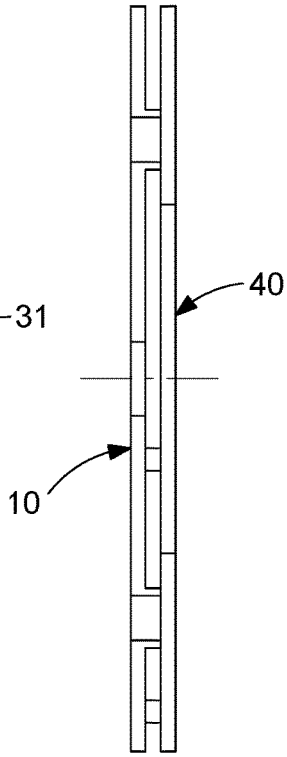
Figure 23:
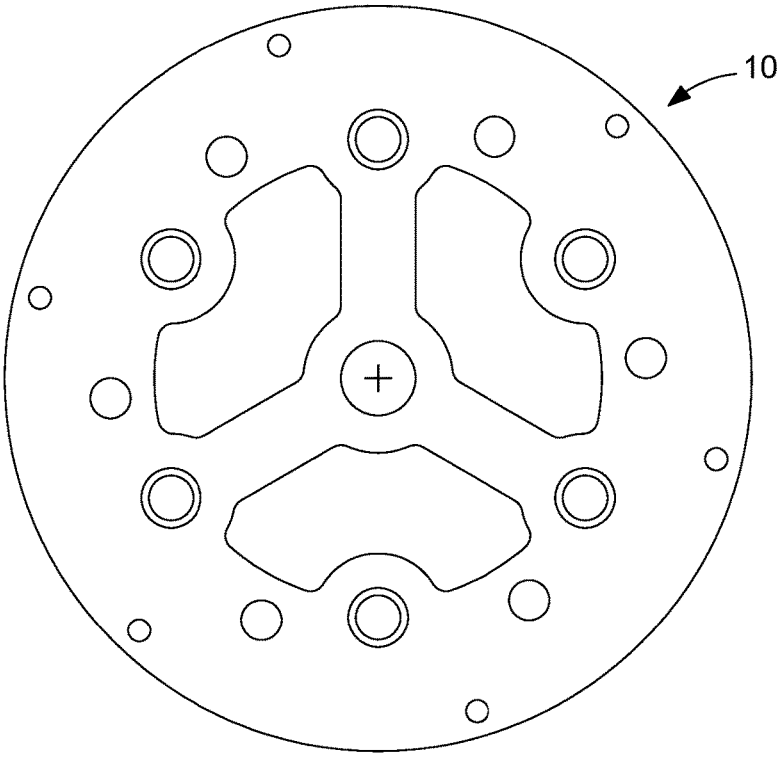
Figure 24:
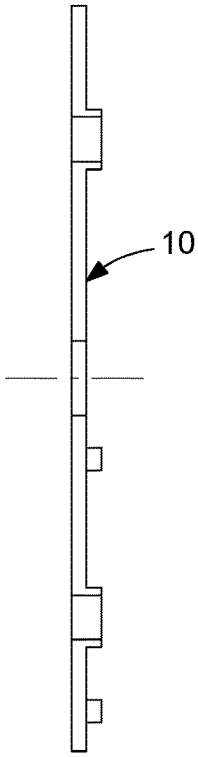
Figure 25:
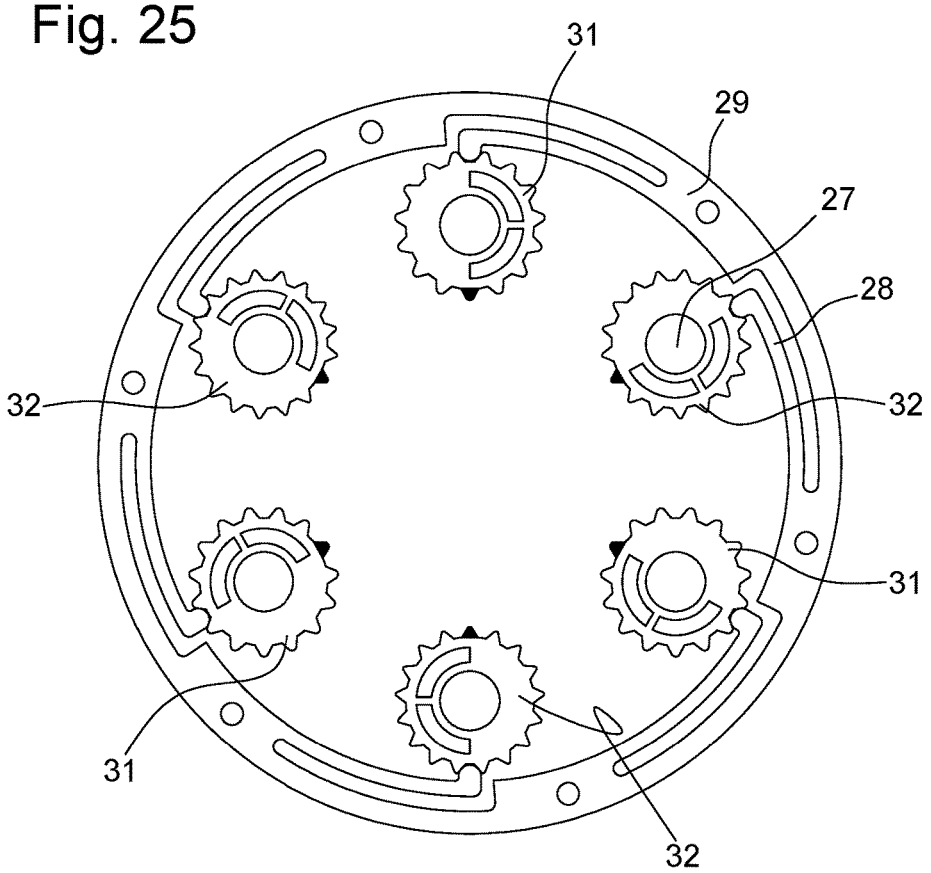
Figure 26:
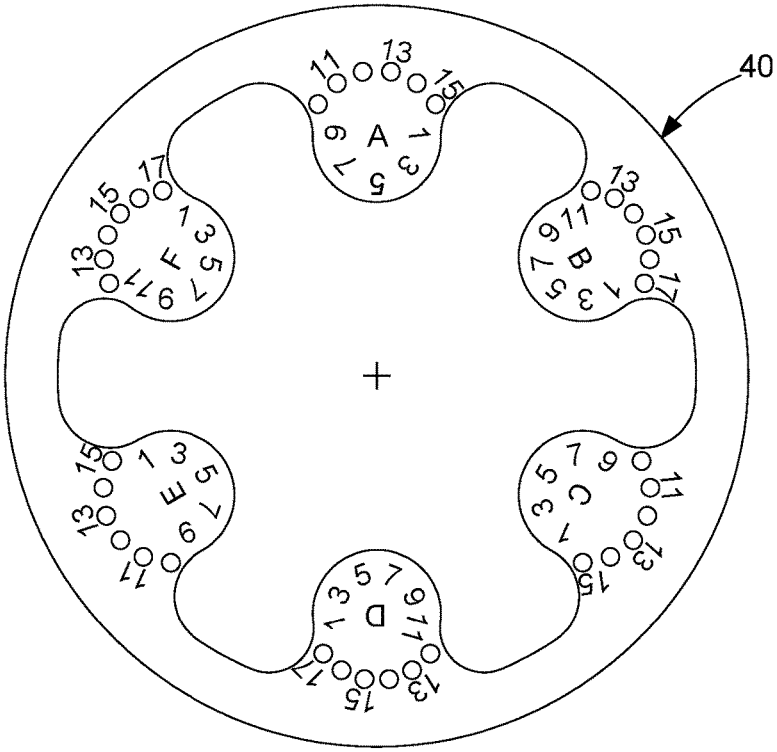
Figure 27:
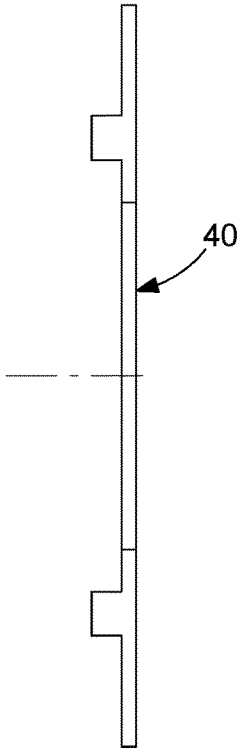
Figure 31:
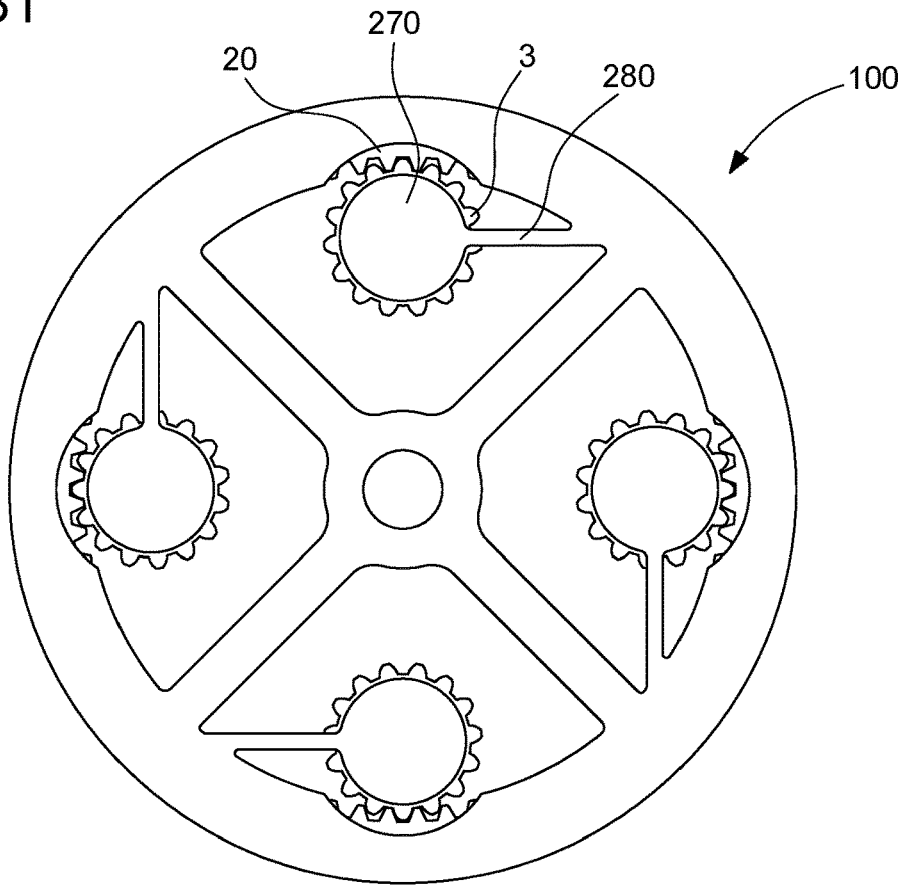
Figure 32:
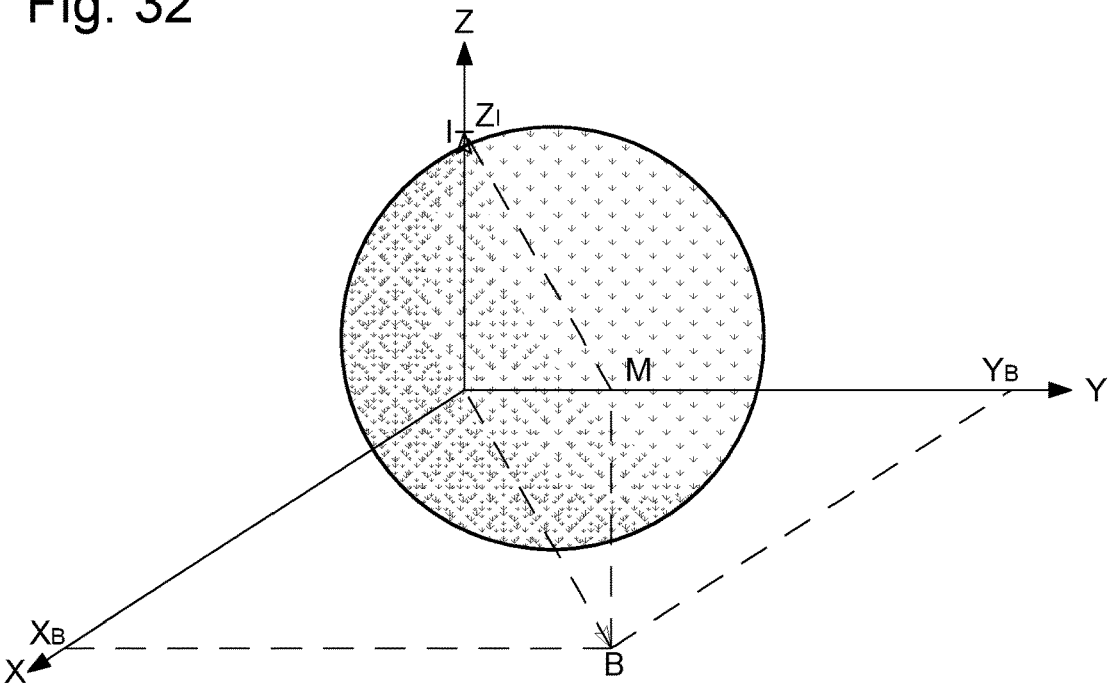

FIG. 31 shows, in a similar way to FIG. 1, another inertial mass constructed on the same principle, which includes a rigid toothed crown, and the satellites of which are able to rotate about pivots each suspended by an elastic blade on at least one of the flanges of the inertial mass, or on these two flanges at the same time; as in FIGS. 20 and 21, this inertial mass forms part of the family of inertial masses synchronised by a crown;

FIG. 32 is a three-dimensional diagram showing schematically, in an extremely simplified way, a network of points in space, which can be formed by a very large number of points provided that a consistent number of satellites are used, such as for example the six mobiles for independent adjustment of FIG. 25, with which it is possible to define tens of thousands of points each corresponding to an unbalance value and an inertia value, these points are shown schematically here by crosses in an envelope sphere, wherein the density of points is variable according to the position in space, this cloud of points of shown purely schematically, and in no way represents the local differences in density of points according to the zones in the sphere, which are dependent on each case;

FIG. 33 is a block diagram showing a timepiece, in particular a watch, including a movement with a resonator equipped with at least one inertial mass according to the invention.

DETAILED DESCRIPTION OF PREFERRED EMBODIMENTS

The invention relates to an inertial mass 100 with adjustment of inertia and/or of unbalance for a horological resonator 400.

The invention is particularly illustrated for the case of a horological resonator 400 of the hairspring type, where the inertial mass is a balance. Naturally the invention is applicable to other types of mechanical resonator, and in particular to flexible-guidance resonators on elastic blades. The invention is also applicable to electromechanical resonators and, in general, to any resonator where it is wished to be able to correct the running in a simple fashion by acting on the inertia of at least one inertial mass of such a resonator.

According to the invention, this inertial mass 100 includes a plurality of mobiles 3 for adjusting inertia and/or unbalance, toothed or fluted, or including discrete angular indexing means. Each of these mobiles 3 for adjusting inertia and/or unbalance is mounted pivotably about a mobile axis DM with respect to at least one flange that the inertial mass 100 includes: lower flange 10 or upper flange 40 in the case of the figures. The centre of mass of each mobile 3 for adjusting inertia and/or unbalance is off-centre with respect to this mobile axis DM. This mobile axis DM is itself off-centre with respect to the centre of inertia of the inertial mass 100. This unbalance is in particular but not limitatively achieved by means of a recess 312, 322, which each of these mobiles 3 includes. Advantageously, these recesses 312, 322 are arranged for the introduction of a special tool, or tweezers, or the like, for angular adjustment of the mobile 3 concerned.

The invention is described here in the particular and non-limitative case of drives by teeth. Naturally the invention is also applicable to other driving and indexing means, such as flutes, spikes or other.

Each mobile 3 for adjusting inertia and/or unbalance cooperates by meshing or indexing cooperation with a single crown for adjusting inertia and/or unbalance 20, toothed or fluted, or provided with complementary indexing means, depending on the type of indexing means that each mobile 3 for adjusting inertia and/or unbalance includes, under permanent constraint, which is exerted by an elastic return force that is exerted by the crown 20 and/or by an elastic return force exerted by the mobile 3 for adjusting inertia and/or unbalance or by the flange 10, 40 that carries this mobile 3.

Thus the crown 20 is either flexible or rigid.

In a particular embodiment, at least two different types of mobile 3 for adjusting inertia and/or unbalance have different numbers of teeth or flutes.

According to the invention, at least two mobiles 3 for adjusting inertia and/or unbalance can be indexed independently of each other for combined adjustment of unbalance and inertia of the inertial mass 100.

In a particular embodiment, all the mobiles 3 for adjusting inertia and/or unbalance 3 of the same inertial mass 100 can be indexed in a combined fashion, that is to say are kinematically linked so as to turn through the same angle during an adjustment operation.

In another particular embodiment, at least one mobile for adjusting inertia and/or unbalance 3 can be indexed independently of a set of at least two other mobiles 3 that can be indexed together in a combined fashion.

In yet another particular embodiment, at least three mobiles 3 for adjusting inertia and/or unbalance can be indexed independently of each other for combined adjustment of unbalance and inertia of the inertial mass 100.

In yet another particular embodiment, all the mobiles 3 for adjusting inertia and/or unbalance of the same inertial mass 100 can be indexed independently of each other for a combined adjustment of unbalance and inertia of the inertial mass 100.

FIGS. 1 to 18 relate to the case of an elastic crown, FIG. 19 the case of elastic supports at one of the flanges, and FIG. 20 the case of elastic satellites.

In the non-limitative example that follows, the inertial mass 100 is a balance, in particular and non-limitatively with a diameter of approximately 10 mm, which includes:

- a lower flange 10, here including a felloe 11, shoulders 13 and 14, arms 12, a central bore 17 at the oscillation axis DO of the inertial mass 100, and brackets 15 carrying guidance piercings 16;
- an upper flange 40 including here a felloe 41, shoulders 43 and 44, and countersinks 45 at the periphery of a large central hollow around the oscillation axis DO of the inertial mass 100, the shoulders 43 and 44 advantageously include first orifices 431 in a first step of 15 divisions with associated marking, and second orifices 441 at a second step of 17 divisions with an associated marking;
- mobiles for adjusting inertia and/or unbalance 3, which here consist of
  - two first satellites 31 of a first type, with a first central bore 311, with an unbalance created non-limitatively by first hollows 312, and a first set of teeth 310 including 15 identical teeth, each first satellite 31 including a first marking 39 of the transfer or mark type on a tooth or similar, to mark the angular position thereof; this marking 39 is shown with a darker zone in FIG. 10, in FIG. 5, and in FIG. 1 through first orifices 431 that the upper flange 40 includes;
  - two second satellites 32 of a second type, with a second central bore 321, with an unbalance created non-limitatively by second hollows 322, and a second set of teeth 320 including 17 identical teeth, each second satellite 32 including a second marking 390 of the transfer or mark type on a tooth, or similar, to mark the angular position thereof; this second marking 390 is shown with a darker zone on FIG. 11, on FIG. 5, and on FIG. 1 through second orifices 441 that the upper flange 40 includes;
- an elastic crown 20, which includes a felloe 2 carrying at least one set of teeth, according to the case internal teeth 21 and/or external teeth 22; in the case of FIG. 5 the internal set of teeth 21 includes 72 teeth.

The choice of the term "satellite" employed here does not necessarily imply the presence of a sun as in other known mechanisms including sun, crown and satellites.

Such satellites 31, 32, are of very small size. Thus, in order to have good precision of manufacture, micromachining technologies are particularly advantageous. It is possible to use all micromachinable materials. For reasons of strength, the preferential technology is the "LIGA" method (from the German "Lithographie, Galvanoformung, Abformung", or "lithography/galvanisation by electrodeposition/forming"), in particular, but non-limitatively of the nickel phosphorus (non-magnetic) type with one or two levels. Naturally it is possible to use variants of this method, in particular using UV rays instead of X-rays, of the original method, or of other similar technologies well known to a person skilled in the art, in particular specialising in MEMS (from the English "microelectromechanical systems") and of the manufacture of components made from micromachinable material made from silicon, oxidised silicon, DLC or similar.

Figure 2:
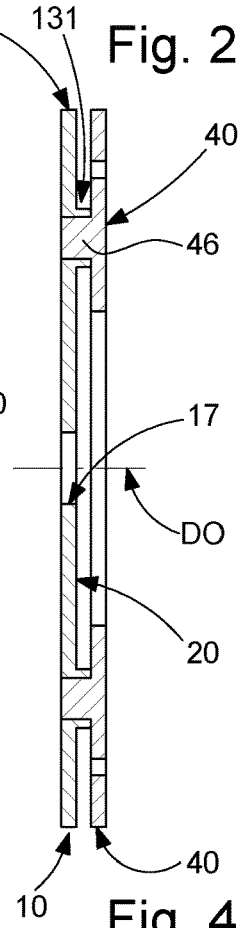
FIG. 2 shows, schematically, and in side view, the assembly of the lower flange and of the upper flange of the complete balance of FIG. 1.
Figure 3:
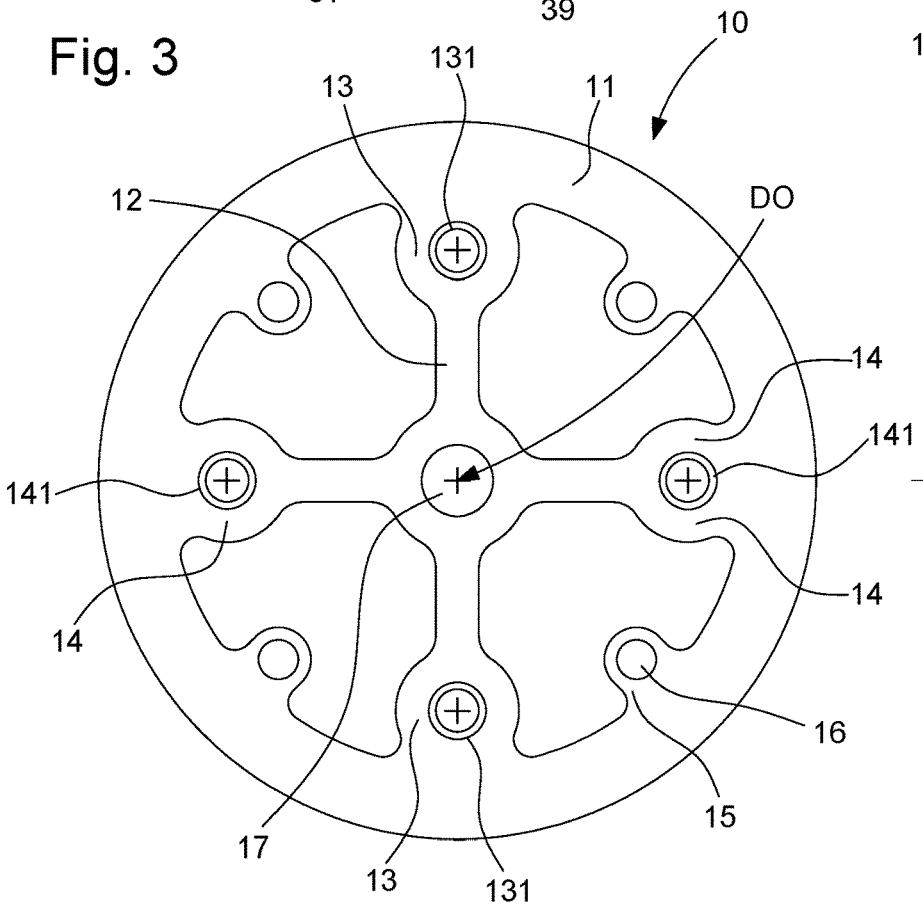
FIG. 3 shows, in a similar way to FIG. 1, solely the lower flange.
Figure 4:
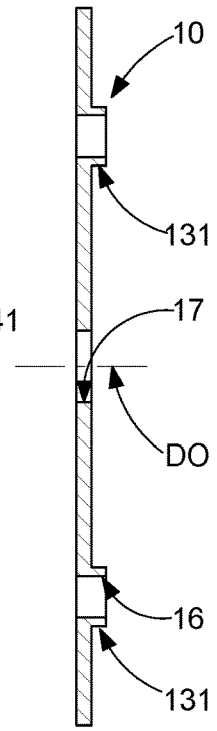
FIG. 4 shows, in a similar way to FIG. 2, the lower flange of FIG. 3.
Figure 8:
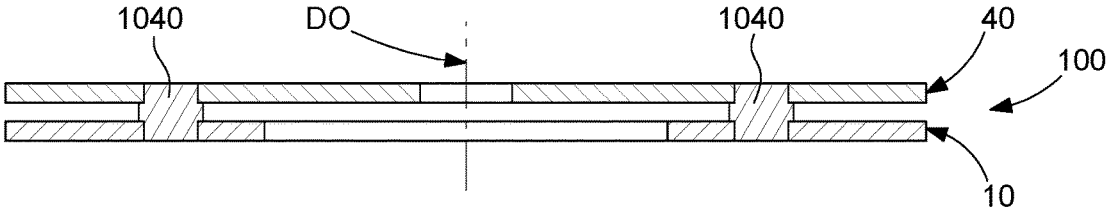
FIG. 8 shows, in a similar way to FIG. 2, a variant where the upper flange and the lower flange are assembled by means of struts, for example laser welded.

FIGS. 1, 5, 9, 10, 11, 14, 15 illustrate a particular and advantageous case where the mobiles for adjusting inertia and/or unbalance 3, in particular satellites 31, 32, are mounted in diametrically opposed pairs with respect to the oscillation axis DO of the inertial mass 100. The mounting of this balance forming the inertial mass 100 of these figures is as follows:

- the four satellites 31 and 32 are placed, in pairs diametrically opposed with respect to the oscillation axis DO of the inertial mass 100, on the lower flange 10, in particular by cooperation of bores 311, respectively 321, that they include, with journals 131, 141, of the lower flange 10 (or vice versa), with the orientation visible in FIGS. 1 and 5, which corresponds to the position of each satellite that corresponds to the middle of the inertia adjustment range,
- the crown 20, which is an elastic crown, is force-fitted around the four satellites 31 and 32. The crown 20 is slightly too small and is therefore under tension and has a spring role and provides the taking up of clearances; this crown 20 includes a felloe 2 carrying at least one set of teeth, according to the case internal teeth 21 and/or external teeth 22,
- driving of the upper flange 40, either directly on the lower flange 10 as can be seen in FIG. 2 at protrusions 46 on the upper flange 40 cooperating with housings 16 in the lower flange, or vice versa, or by means of struts 1040 as can be seen in FIG. 8. In a variant, laser welding spots are made or an irreversible junction is produced by a similar method, in order to guarantee holding of the two lower 10 and upper 40 flanges on each other,
- the balance 100 is next conventionally matched with its balance spring. The balance/balance spring assembly can then, as for a standard balance, be balanced and set at the frequency roughly by removal or addition of material, and then finely by means of the object of the invention.

More particularly, each mobile 3 for adjusting inertia and/or unbalance is enclosed between the lower flange 10 and the upper flange 40.

More particularly, the crown 20 is enclosed between the lower flange 10 and the upper flange 40.

Preferably the lower flange 10 or the upper flange 40 includes, facing at least one mobile 3, and preferably facing each mobile 3, at least one marking and/or one orifice 431, 441, for marking a single visual indicator that this mobile 3 for adjusting inertia and/or unbalance includes.

More particularly, the lower flange 10 and the upper flange 40 are fixed to each other irreversibly.

In this embodiment according to FIGS. 1, 5, 9, 10, 11, 14, 15, the main role of the elastic crown 20 is to synchronise the angular positions of the two pairs of satellites 31, 32, so as to vary only the inertia without introducing any unbalance. In addition, the tension of the elastic crown 20 applied to the journals 131, 141 of the lower 10 and upper 40 flanges eliminates the clearances between the various components, and creates stable positions at each advance by one step, in particular of a tooth, of each of the four mobiles 3 at a time, which makes it possible to dispense with a jumper, which is in general necessary in horology in order to impose stable positions but which is a great consumer of space.

In this particular example, the combination of the positions of the four satellites 31 and 32 makes it possible to obtain 255 stable positions, and at a maximum the same number of different inertias, by turning the crown 20, by the combination of the 15 teeth and the 17 teeth that these satellites 31 and 32 respectively include.

FIG. 9A shows the position of the points of contact:

- 38 between the crown 20 and the satellite 31 or 32,
- and 37 between the satellite and the guide shaft of the satellite, in particular a journal 131.

This position forming a triangle of forces with the points 38 and 37 is stable and corresponds to a minimum elastic potential energy.

FIG. 9B illustrates another variant in which each mobile 3 is carried by a shaft or a journal provided with two slight protuberances 3110, and thus the points of contact form together a trapezium of forces, which confers a positioning of the satellite that is even better than with a triangle, because of less deformability. This is because the triangle can change from isosceles (nominal position) to regular (off-centre position) because of the friction between a circular shaft and bore, whereas the trapezium of forces scarcely deforms at all.

During rotation, the crown 20 is subjected to bending that forces the whole of the system to reposition itself in a stable and centrosymmetrical position.

The crown 20 comprises internal synchronisation teeth 21 and, in a variant, external teeth 22. FIGS. 15 and 18 illustrate other variants of a complete resonator, the external teeth 22 of the crown 20 are concealed by the upper flange.

FIGS. 10 and 11 illustrate a particular variant where, advantageously, the form of the teeth of the crown and of the satellites differs according to the component concerned. The forms of the teeth 39, and respectively 390, of the first satellites 31 with 15 teeth, and respectively of the second satellites 32 with 17 teeth, are optimised in order to minimise the clearance in a stable position and not to jam duration rotation. The forms of the teeth are different, since the teeth pitches are not the same, since in this particular variant the primitive diameters (and therefore the unbalances) are identical.

It is also possible, in another variant that is not illustrated, to have teeth with the same form for the two pairs of satellites, changing the diameter of one of the pairs in order to have equivalent teeth pitches.

In order to adjust the inertia of the balance, it can therefore be seen, in this same example of FIGS. 1, 5, 9, 10, 11, 14, 15, that the combination of the positions of the four satellites 31 and 32 makes it possible to obtain at a maximum 255 different inertia values (15 teeth×17 teeth, as shown by the graph of the running on FIG. 12, according to rotation clicks of the crown 20 (data for inertia and masses of the specific planetary wheels and balance). The zero position corresponds to the situation in FIG. 5, and the crown 20 is then turned in the anticlockwise direction.

The sinusoidal trend of the running graph according to the adjustments of unbalance is a moiré effect, or a beat of the combination of the two pairs of unbalances slightly offset at the number of teeth.

It can be seen that, around the maxima of the sines, the resolution per notch is fine, and that there are a plurality of maxima at different heights, which confers on the system both high resolution and a large adjustment range. As there does not exist any linear relationship between the number of clicks and the inertia, the following table is an extract of a global table setting out all the adjustments for the 255 positions, and indicates only a few angular positions of the satellites (out of the 255 possible) and of the crown, and the corresponding variations in inertia with respect to the median value at position 128. The graph shows the variation in inertia for the 255 positions relative to the total range of inertia variation (Imax−Imin). The satellites in this balance are in the median position of the adjustment of the inertia.

| | variation in inertia dI/(Imax-Imin) | 15 tooth satellite position i | 17 tooth satellite position j | crown position k |
|---|---|---|---|---|
| 1 | −0.500 | 9 | 11 | −4 |
| 2 | −0.492 | 9 | 10 | −124 |
| 3 | −0.489 | 10 | 11 | −123 |
| 4 | −0.481 | 10 | 10 | 12 |
| 5 | −0.475 | 9 | 12 | 116 |
| 6 | −0.468 | 8 | 11 | 115 |
| 7 | −0.464 | 10 | 12 | −3 |
| . . . | . . . | . . . | . . . | . . . |
| 125 | −0.0061 | 6 | 6 | 8 |
| 126 | −0.0027 | 1 | 10 | 63 |
| 127 | −0.0003 | 2 | 11 | 64 |
| 128 | 0 | 13 | 15 | 0 |
| 129 | −0.0003 | 9 | 2 | −64 |
| 130 | −0.0027 | 10 | 3 | −63 |
| 131 | −0.0061 | 5 | 7 | −8 |
| . . . | . . . | . . . | . . . | . . . |
| 251 | 0.475 | 2 | 1 | −116 |
| 252 | 0.481 | 1 | 3 | −12 |
| 253 | 0.489 | 1 | 2 | 123 |
| 254 | 0.492 | 2 | 3 | 124 |
| 255 | 0.500 | 2 | 2 | 4 |

If an example is taken according to the position corresponding to line 4 in the above table:

- the first satellite 31 with 15 teeth is at the position i=10, and the second satellite 32 with 17 teeth is at the position j=10;
- measurement of the running indicates that it is necessary to increase the inertia by a value of 0.969:
- 0.969 is added to −0.481 (first column in the table) and 0.488 is obtained for the resulting new inertia;
- the closest inertia value on the table is sought and the values are taken from line 253 in the table: the first satellite 31 with 15 teeth must go to the position i=1, and the second satellite 32 with 17 teeth must go to the position j=2;
- to make the change it is necessary to turn the crown from position 12 to position 123 (last column in the table). To assist the operator, an algorithm advantageously makes it possible to calculate the number of turns of the satellites to be made.

It will be understood that the diametrically opposite satellites are adjusted identically, in order to guarantee that the centre of mass of the whole of the inertial mass 100 remains on its oscillation axis DO. Differentiated adjustments would certainly make it possible to obtain even more possibilities of adjustment of inertia and/or of unbalance, but at the cost of a resulting unbalance that is off-centre with respect to the oscillation axis DO, which is not generally desired.

In this particular example, the satellites have 15 to 17 teeth, but there exists a large number of combinations of numbers of teeth that make it possible to have satellites of different sizes with a number of combinations of positions that follows the size of the satellite or the number of teeth. The graph in FIG. 13 shows all these relative inertias ordered by increasing values. The least good resolution corresponds to the maximum jump between two consecutive values. It can be seen clearly that these maximum jumps are very small compared with the entire range.

In a particular variant, the number of teeth or flutes of at least one type of satellite is a prime number.

In another particular variant, the numbers of teeth or flutes of at least two different types of satellite have numbers that are prime with each other.

In yet another variant, the numbers of teeth or flutes of all the various types of satellite are numbers that are prime with each other.

In addition, by modifying the angular phase difference between the teeth of the satellite and their unbalance, it is possible not only to achieve 255 unique discrete levels, but also reduced maximum jumps. The resolution can thus be optimised.

For controlling the adjustment of inertia and/or of unbalance when the resonator is in position in a watch, it is possible to adjust the inertia with a wheel internal to the movement, which is visible in FIG. 14.

The documents EP 3252545 B1 and EP 3252546 B1 in the name of Swatch Group Research & Development Ltd, incorporated here by reference, relate to a mechanism that makes it possible to turn the crown with a driving wheel 5, which a drive mechanism 50 includes. Preferably, the form of the external teeth 22 of the crown 20, and the form of the teeth 51 of the driving wheel 5, is very pointed, in order to minimise the forces and the risk of damaging the teeth during engagement.

Manipulation is easy, since the unitary tangential movement of a notch is 0.44 mm at the crown 20, a sufficiently long path for this example diameter of 10 mm.

Another variant, as can be seen in FIGS. 15 to 17, consists of adjusting the inertia with an external wheel 6 mounted at the end of a tool 7 manipulated by the watchmaker: the inertia can thus be modified directly on the balance with a tool composed of a screwdriver with a toothed wheel at the end, or similar. In order to facilitate the positioning of the tool, the lower flange 10 advantageously includes piercings 16, for example on brackets 15, in particular facing countersinks 45 on the felloe 41 of the upper flange 40, in order to centre and guide the distal end of this tool 7, in particular a journal 71 or the like, in order to guide the end of the tool 7 that projects beyond its external wheel 6. The upper flange 40 includes a countersink 45 in line with each piercing 16 (in particular produced in a bracket 15), and thus the teeth 61 on the external wheel 6 of the tool 7 can mesh directly with the internal teeth 21 on the crown 20.

By having the possibility of adjusting the inertia with such an external tool 7, it is also possible, in another similar embodiment, to envisage a conventional balance 100 without internal integral adjustment. In this case it is possible to eliminate the external teeth on the crown 20.

In a variant, keeping the external teeth 22 on the crown 20, it is possible to envisage putting the satellites 31, 32 outside the crown 20.

FIG. 18 illustrates a tool adapted for introducing the satellites during assembly: a ring 9 includes internal eccentric cams 91 for the radial movement of sliding carriages 8 arranged so as to immobilise or release the elastic crown 20, when this ring is rotated through 90°, the sliding carriages compress and deform the elastic ring 20, which makes it possible to place the satellites 3 easily without colliding with the elastic crown 20.

FIGS. 19 and 20 are details of flanges of certain variants.

FIGS. 21 to 27 relate to an inertial mass that does not include an elastic toothed crown and the satellites 31, 32 of which are independent of one another, and are indexed by elastic blades 28 secured to one of the flanges of the inertial mass.

FIGS. 28 to 30 illustrate a balance with three mobiles for adjusting inertia and/or unbalance formed by three satellites 60, which, in this figure, conceal three arms joining the felloe at the central part of axis DO. These three third identical satellites 60 here have sets of teeth 61 with 30 teeth, and the crown 20 includes 72 teeth. Adjustment of the inertia is simplified given a sinusoidal monotonic relationship between clicks and inertia, but there are only 16 adjustment positions. Maintenance of the centre of mass on the oscillation axis is provided by the synchronisation of identical adjustments on each of the third satellites 60. All the unbalances are synchronised.

FIG. 31 relates to another inertial mass 100, which includes a rigid toothed crown 20, and the satellites 3 of which are mounted elastically on flexible blades 28 formed in at least one of the two flanges, or in both flanges, the principle being in all respects identical to that illustrated by FIGS. 1 to 15.

The invention also relates to an inertia and/or unbalance adjustment assembly 150 for a horological resonator 400 including at least one such inertial mass with inertia and/or unbalance adjustment 100, this assembly 150 including this inertial mass with inertia and/or unbalance adjustment 100. According to the invention, this inertia and/or unbalance adjustment assembly 150 includes firstly a two-dimensional (FIG. 12) or three-dimensional (FIG. 32) diagram, associated secondly with a table or file of values, defining together the inertia and/or unbalance value of the inertial mass with adjustment of inertia and/or unbalance 100 according to the position occupied by each of the mobiles 3 for adjustment of inertia and/or unbalance that this inertial mass 100 with adjustment of inertia and/or unbalance includes.

More particularly, this inertia and/or unbalance adjustment assembly 150 includes a tool including an external wheel 6 arranged to mesh with teeth 21, 22 that the crown 20 of this inertial mass 100 includes, or the like.

The invention also relates to a horological resonator 400 including at least one such inertial mass with adjustment of inertia and/or unbalance 100 or at least one such inertia and/or unbalance adjustment assembly 150.

The invention also relates to a horological movement 500 including at least one such resonator 400. This movement 500 advantageously includes a drive mechanism 50, arranged to cooperate with teeth on the crown 20. FIG. 14 illustrates the case where this drive mechanism 50 includes a driving wheel 5, which includes teeth 51 arranged to cooperate with the external teeth 22 on the crown 20, in the non-limitative illustrated case where the crown includes such teeth. Naturally a similar arrangement is possible if the crown 20 includes an indexing means other than teeth, such as flutes or the like, the driving wheel 5 then includes the appropriate profile, complementary to that of the crown 20.

In a particular embodiment, not illustrated in order not to overload the figures, this drive mechanism 50 is disengageable, in order not to restrict the inertial mass 100 during the oscillation of the resonator mechanism 400, nor to interfere with this oscillation in any way whatsoever. FIGS. 1, 14, 16, 20, 21 of the documents EP 3252545 B1 and EP 3252546 B1 in the name of Swatch Group Research & Development Ltd describe such an engagement mechanism with magnetocoupler integrated in the watch.

The invention also relates to a timepiece 1000, in particular a watch, including at least one horological movement 500 including at least one such resonator 400.

The invention lends itself to numerous variants. Thus another variant, illustrated by FIGS. 21 to 26, relates to a balance with satellites 31, 32, cooperating with elastic blades 28: the satellites 31, 32 then pivot on shafts 27 carried by the flange or flanges. The elastic blades 28 allow a radial movement of the satellites, and index the angular movement thereof. The spring function for taking up clearance of the crown is adopted by these elastic blades 28. FIG. 25 illustrates six mobiles 3 with independent adjustments; other configurations can be envisaged, in particular with four independent mobiles, or other.

The variant illustrated includes three pairs of satellites with, in the example, but not limited to, 15 and 17 teeth, which make it possible to adjust the unbalance and the inertia of the balance: in this way the advantage of the ease of adjustment with discrete positions independent of each other of the satellites is kept. The tool in FIG. 16 can also be used for carrying out the adjustment. Naturally other variants can be imagined, for example a balance with an even number of satellites of each kind, for example eight satellites, including four for adjustment of the unbalance and four for adjusting the inertia, which then makes it possible to clearly decouple the two adjustments. Thus, some mobiles 3 are allocated solely to adjustment of inertia, and the other mobiles 3 are allocated solely to adjustment of the unbalance. It is also possible to imagine mobiles 3 having diameters different from each other, and/or mobiles 3 carried on different portage diameters, and/or mobiles 3 with unbalances that are different from each other, and/or mobiles 3 with hollows 312, 322 different from each other, and/or mobiles 3 made from materials with different densities, or other, so as to cover an extensive set of points, in a similar fashion to the cloud of points in FIG. 32.

FIG. 32 thus illustrates a particular configuration in which at least three mobiles can be indexed independently of one another for a combined adjustment of unbalance and inertia of the inertial mass 100. By analogy with FIG. 12, which is a flat distribution diagram of 255 different inertia values, FIG. 32 is a three-dimensional diagram showing schematically, in an extremely simplified way, a network of points in space, which can be formed by a very large number of points provided that a corresponding number of satellites are used, such as for example the six mobiles 3 with independent adjustment in FIG. 25, with which it is possible to define tens of thousands of points each corresponding to an unbalance value and an inertia value, these points are shown schematically here by crosses in an envelope sphere, in which the density of points is variable according to the position in space (as is also the case in FIG. 12). The unbalance value B is given by the projection of a point M in question on the plane XY, according to the coordinates Xb and Yb, while the value of the inertia I is given by its projection on the axis Z and its coordinate Zi: a point M in the sphere corresponds to a unique position of each of the mobiles 3.

The spring function can also be provided by the satellites 3 themselves, microstructuring techniques making it possible to form elastic radii.

The invention also relates to a method for adjusting inertia and/or unbalance of an inertial mass for a horological resonator, according to which:

- an inertia and/or unbalance adjustment assembly 150 for a horological resonator 400 is obtained, according to the invention, said assembly 150 including such an inertial mass for adjusting inertia and/or unbalance 100, and the associated elements, that is to say firstly a said two-dimensional or three-dimensional diagram, and secondly a said table or file of values;
- a measurement of the running of the resonator is made;
- the algebraic value of the correction of inertia to be made is determined;
- the value closest to this correction of inertia is sought in said table or file;
- the new position to be given to each mobile 3 is determined;

each satellite mobile is positioned by rotating the crown and/or said satellite mobile according to the configuration of said inertial mass.

More particularly, the new position to be given to each mobile 3 is determined so as to minimise the unbalance resulting from the mobiles 3.

Naturally this method is applicable both to the two-dimensional diagram in FIG. 12 and to the three-dimensional diagram in FIG. 32.

All in all, the invention is distinguished in that:

- a crown forming a spring cooperates with satellites, takes up clearances and creates stable and precise positions without creating a dynamic unbalance;
- a wide choice of combinations of satellites, with different numbers of teeth, different diameters and different unbalances creates, by a moiré effect, a large number of discrete inertia values of the balance while having a high range/resolution ratio.

The invention thus offers numerous advantages:

- possibility of use of strong and precise micromachined components. The absence of thin blades increases the strength thereof;
- fine and reproducible adjustment of the inertia of an oscillator inertial mass, and therefore of the running;
- high resolution;
- possibility of adjustment from inside and/or outside the watch;
- large inertia and/or unbalance adjustment range, and absence of dynamic unbalance;
- taking up clearances by the slight constraint between the crown and the satellites, and maintenance of the mobiles in several tens or hundreds of stable positions;
- exact adjustment on the basis of a table of positions;
- precise and easily legible indication of the adjustment of the inertia;
- easy manipulation since the unitary travel (one click) is relatively large on a horological scale;
- maintenance of the centre of mass on the oscillation axis of the inertial mass if a centrosymmetrical geometry is chosen, with an identical adjustment of the diametrically opposed satellites;
- absence of stop in rotation and therefore absence of risk of breaking during adjustment;
- in the case where the inertial mass is a balance:
- at each position, all the geometry is equivalent, except for the unbalance of the satellites and the fine flexible felloe. This minimises the dynamic unbalances of the balance;
- wide countersink at the centre of the balance for housing the balance spring;
- conventional mounting of the balance felloe on the balance shaft.

All in all, the invention makes it possible to effect a precise adjustment of inertia by virtue of inertia and/or unbalance adjustment mobiles that are synchronised by a single crown.

The moiré effect is due to the combination of phase difference of N pairs of adjustment mobiles, and the use of a table for decoding the inertia/running obtained affords security of use making it possible to proceed directly with the adjustment with precision, the algorithm essential to decoding constituting in this regard a precious contribution of the invention.

The invention allows adjustment of unbalance of the balance by mobiles with unbalances non-synchronised by a crown, and especially which are independent of the satellite mobiles. And these mobiles with unbalances non-synchronised by a crown can be added to the first system.

The invention claimed is:

1. An inertial mass with adjustment of inertia and/or of unbalance for a horological resonator, wherein said inertial mass includes a plurality of mobiles for adjusting inertia and/or unbalance, toothed or fluted, each mounted pivotally about a mobile axis with respect to a flange included in said inertial mass, said mobile axis being off-centre with respect to the centre of inertia of said inertial mass, and with a centre of mass off-centre with respect to said mobile axis, each said mobile cooperating by meshing with the same single inertia and/or unbalance adjustment crown included in said inertial mass, said crown being toothed or fluted, under permanent constraint exerted by an elastic return force exerted by said crown and/or by an elastic return force exerted by said mobile or by the flange that carries it, and wherein at least two said mobiles for adjusting inertia and/or unbalance can be indexed independently of each other for combined adjustment of unbalance and inertia of said inertial mass.

2. The inertial mass according to claim 1, wherein at least three said mobiles for adjusting inertia and/or unbalance can be indexed independently of each other for combined adjustment of unbalance and inertia of said inertial mass.

3. The inertial mass according to claim 1, wherein at least two different types of said mobiles for adjusting inertia and/or unbalance have different numbers of teeth or flutes.

4. The inertial mass according to claim 3, wherein at least two said different types of said mobiles for adjusting inertia and/or unbalance have different numbers of teeth or flutes.

5. The inertial mass according to claim 3, wherein the numbers of teeth or flutes of at least two different types of said mobiles for adjusting inertia and/or unbalance are numbers prime with each other.

6. The inertial mass according to claim 3, wherein at least two said different types of said mobiles for adjusting inertia and/or unbalance have different tooth or flute profiles.

7. The inertial mass according to claim 1, wherein the number of teeth or flutes of at least said mobile for adjusting inertia and/or unbalance is a prime number.

8. The inertial mass according to claim 1, wherein said mobiles for adjusting inertia and/or unbalance are arranged in pairs of mobiles of the same type mounted in symmetry with respect to the oscillation axis of said inertial mass.

9. The inertial mass according to claim 1, wherein each said mobile for adjusting inertia and/or unbalance has an unbalance produced by at least one hollow, arranged for the introduction of a tool for the angular adjustment of said mobile for adjusting inertia and/or unbalance concerned.

10. The inertial mass according to claim 1, wherein each said mobile for adjusting inertia and/or unbalance is enclosed between a lower flange and an upper flange.

11. The inertial mass according to claim 10, wherein said crown is enclosed between said lower flange and said upper flange.

12. The inertial mass according to claim 10, wherein said lower flange or said upper flange includes at least one marking and/or orifice for marking a unique visual indicator that a said mobile for adjusting inertia and/or unbalance includes.

13. The inertial mass according to claim 10, wherein said lower flange and said upper flange are fixed to each other irreversibly.

14. The inertial mass according to claim 10, wherein said inertial mass is associated with a table intended for the table operator directly correlating the difference in running with numbered discrete positions imposed on said mobiles for adjusting inertia and/or unbalance and on said crown.

15. The inertial mass according to claim 1, wherein some of said mobiles are allocated solely to the adjustment of inertia, and wherein the other said mobiles are allocated solely to adjustment of the unbalance.

16. An inertia and/or unbalance adjustment assembly for a horological resonator, comprising at least one inertia and/or unbalance adjustment mass according to claim 1, and a two-dimensional or three-dimensional diagram associated with a table or file of values, defining together the value of the inertia and/or of the unbalance of said inertial mass for adjustment of inertia and/or unbalance according to the position occupied by each of said mobiles for adjusting inertia and/or unbalance included in said inertial mass for adjustment of inertia and/or unbalance.

17. The inertia and/or unbalance adjustment assembly according to claim 16, wherein said assembly includes at least one tool including a toothed wheel arranged to mesh with teeth that said crown includes.

18. A method for the adjustment of inertia and/or unbalance of an inertial mass for a horological resonator, wherein:

an inertia and/or unbalance adjustment assembly according to claim 16 is obtained, a measurement is made of the running of said resonator;

the algebraic value of the inertia correction to be made is determined;

the value closest to said inertia correction is sought in said table or file;

the new position to be given to each said mobile is determined;

each said mobile is positioned by rotating said crown and/or said mobile according to the configuration of said inertial mass.

19. The method according to claim 18, wherein the new position to be given to each said mobile is determined so as to minimize the unbalance resulting from said satellite mobiles.

20. A horological resonator comprising at least one inertial mass for adjustment of inertia and/or unbalance according to claim 1, or at least one inertia and/or unbalance adjustment assembly.

21. A horological movement comprising at least one horological resonator according to claim 20.

22. The movement according to claim 21, wherein said movement comprises a drive mechanism arranged to cooperate with teeth that said crown includes.

23. The movement according to claim 22, wherein said drive mechanism comprises a driving wheel, the teeth of which are arranged to cooperate with the external teeth on said crown and said drive mechanism is disengageable, in order not to restrict the inertial mass during the oscillation of said resonator mechanism carrying said inertial mass.

24. A timepiece or watch comprising at least one horological movement according to claim 21.

* * * * *